US007010563B2

(12) United States Patent
Comer et al.

(10) Patent No.: US 7,010,563 B2
(45) Date of Patent: Mar. 7, 2006

(54) MULTIPLIER WITH OUTPUT CURRENT SCALING

(75) Inventors: David J. Comer, Springville, UT (US); Aaron K. Martin, Hillsboro, OR (US); James E. Jaussi, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 589 days.

(21) Appl. No.: 10/106,617

(22) Filed: Mar. 26, 2002

(65) Prior Publication Data

US 2003/0184338 A1 Oct. 2, 2003

(51) Int. Cl.
*G06G 7/16* (2006.01)

(52) U.S. Cl. ..... 708/835; 327/356

(58) Field of Classification Search ..... 708/835; 327/356

See application file for complete search history.

(56) References Cited

U.S. PATENT DOCUMENTS

| | | | | |
|---|---|---|---|---|
| 4,801,827 A * | 1/1989 | Metz | ..... | 327/280 |
| 5,925,094 A * | 7/1999 | Kimura | ..... | 708/835 |
| 5,952,867 A * | 9/1999 | Choi | ..... | 327/346 |
| 6,456,142 B1 * | 9/2002 | Gilbert | ..... | 327/356 |

* cited by examiner

*Primary Examiner*—Tan V. Mai
(74) *Attorney, Agent, or Firm*—Schwegman, Lundberg, Woessner & Kluth, P.A.

(57) ABSTRACT

A multiplier includes an input stage to receive input signals to provide currents at a plurality of source nodes. An output stage includes a plurality of transistor groups, each of the transistor groups includes a plurality of transistor pairs. The values of currents produced by the output stage can be controlled by selecting appropriate parameters of the transistor pairs.

30 Claims, 4 Drawing Sheets

MULTIPLIER WITH OUTPUT CURRENT SCALING

FIELD

Embodiments of the present invention relate generally to electrical signal processing and, in particular, to multipliers.

BACKGROUND

Certain signal processing applications use multipliers to perform mathematic operations such as multiplication. A multiplier multiplies one or more input signals to produce a product signal that is proportional to the input signals.

FIG. 1 shows a conventional multiplier. Conventional multiplier 100 has Transistors M1 and M2 to receive input signals Vs1 and Vs2 to produce currents Ix and Iy. Transistors M3 and M5 pass Ix to nodes 101 and 102. Transistors M4 and M6 pass Iy to nodes 101 and 102. At node 101, current Ia equals the sum of a portion of Ix and a portion of Iy. At node 102, current Ib equals the sum of another portion of Ix and another portion of Iy. A weighting voltage Vw is applied to the gates of transistors M4 and M5. Ia and Ib are the product of Vs1 and Vs2 and Vw.

In multiplier 100, the sum of Ia and Ib equals the sum of Ix and Iy because all of Ix and Iy flow to nodes 101 and 102. In some applications, the full amount of Ix and Iy flowing to node 101 and 102 is too great. The output current could overload a circuit connected to the output of the multiplier.

For these and other reasons stated below, and which will become apparent to those skilled in the art upon reading and understanding the present specification, there is a need for an improved multiplier.

DESCRIPTION OF EMBODIMENTS

Figure 1:
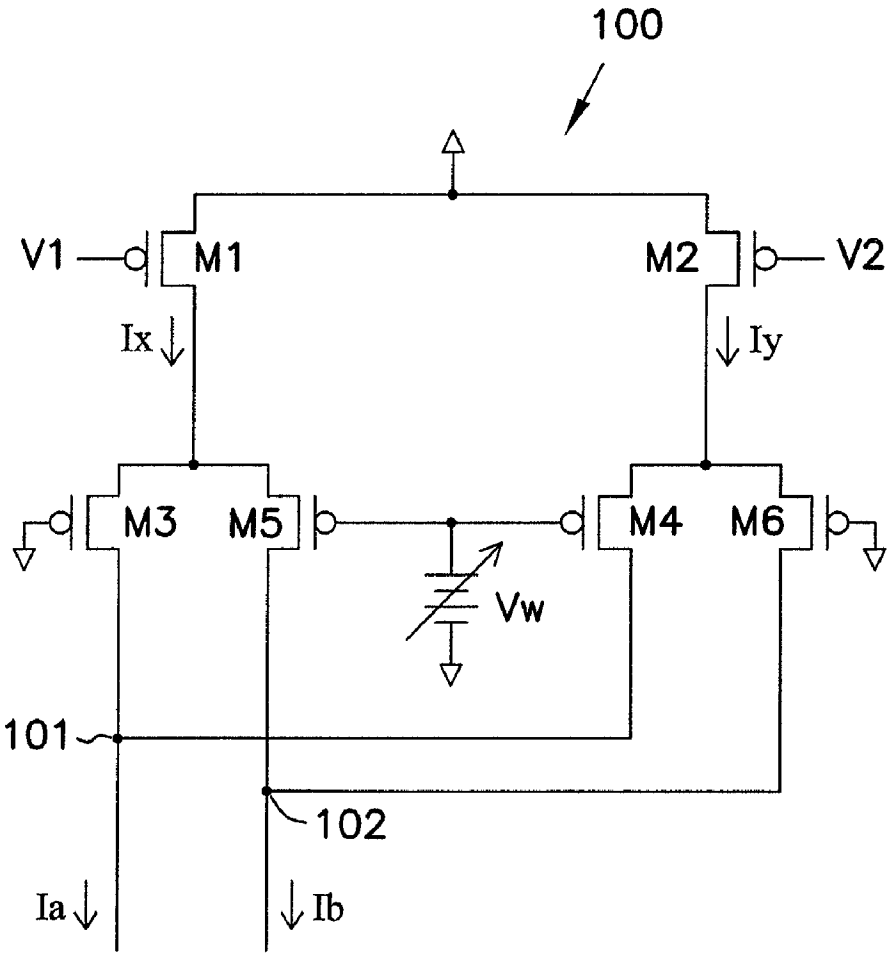
FIG. 1 (PRIOR ART)
FIG. 1 shows a conventional multiplier.

The following detailed description of the embodiments refers to the accompanying drawings that show, by way of illustration, specific embodiments in which the invention may be practiced. In the drawings, like numerals describe substantially similar components throughout the several views. These embodiments are described in sufficient detail to enable those skilled in the art to practice the invention. Other embodiments may be used and structural, logical, and electrical changes may be made without departing from the scope of the present invention. Moreover, the various embodiments of the invention, although different, are not necessarily mutually exclusive. For example, a particular feature, structure, or characteristic described in one embodiment may be included within other embodiments. Therefore, the following detailed description is not to be taken in a limiting sense, and the scope of the present invention is defined only by the appended claims, along with the full scope of equivalents to which such claims are entitled.

Figure 2:
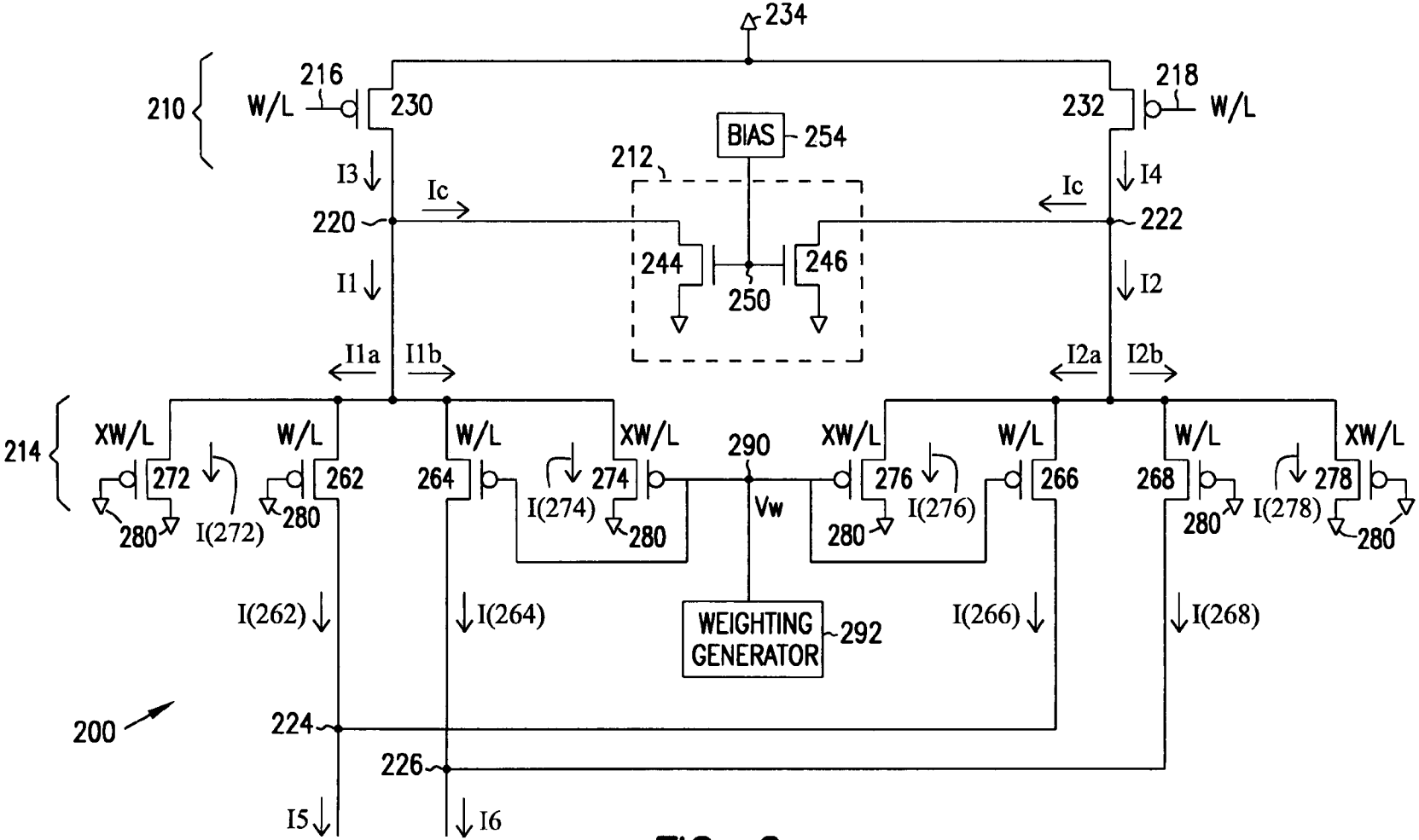
FIG. 2 shows a multiplier having scaling transistors.

FIG. 2 shows a multiplier having scaling transistors. Multiplier 200 includes an input stage 210, a current reduction unit 212, an output stage 214, input nodes 216 and 218, source nodes 220 and 222, and summing nodes 224 and 226. Input stage 210 connects to nodes 216 and 218 to receive input signals V1 and V2. Current reduction unit 212 connects to nodes 220 and 222 and draws a current Ic from nodes 220 and 222. Output stage 214 connects to nodes 220 and 222 to receive currents I1 and I2. Output stage 214 also connects to node 224 to provide an output current I5 and node 226 to provide an output current I6.

Input stage 210 includes input transistors 230 and 232. Transistor 230 has a source connected to a supply node 234, a drain connected to node 220, and a gate connected to node 216. Transistor 232 has a source connected to node 234, a drain connected to node 222, and a gate connected to node 218.

Transistors 230 and 232 form a pair of transistors to receive V1 and V2 and generate input currents I3 and I4. In some embodiments, transistors 230 and 232 are differential pair of transistors and V1 and V2 are differential input voltage signals, in which V1 swings in one direction while V2 swings in the opposite direction. Transistor 230 receives V1 at its gate and converts it into I3 at its drain. I3 is proportional to V1. Transistor 232 receives V2 at its gate and converts it into I4. I4 is proportional to V2. A portion of I3 feeds to output stage 214 as I1. A portion of I4 feeds to output stage 214 as I2. In some embodiments, transistors 230 and 232 are constructed such that current I3 is a linear function of V1, and I4 is a linear function of V2.

Current reduction unit 212 subtracts an unused portion of a DC current from I3 and I4. I3 is a mix of a DC current and a signal current generated by V1 and I4 is a mix of a DC current and a signal current generated by V2. Current reduction unit 212 subtracts an unused portion of the DC current from I3 to provide I1 and an unused portion of the DC current from I4 provide I2. Ic is the unused portion of the DC current. Thus, I1=I3−Ic and I2=I4−Ic.

Current reduction unit 212 includes transistors 244 and 246 having gates connected to a common node 250 to receive a bias voltage Vbias. A bias unit 254 generates Vbias. Transistor 244 forms a first current source connected between nodes 250 and 220 to subtract Ic from node 220. Transistor 246 forms a second current connected between nodes 250 and 222 to subtract Ic from node 222. Ic can be adjusted by choosing an appropriate Vbias.

Output stage 214 includes output transistors 262, 264, 266, and 268, and scaling transistors 272, 274, 276, and 278. The output transistors and the scaling transistors form a differential configuration such that transistors 262 and 272 form one transistor group connected to node 220 and transistors 264 and 274 form another transistor group connected to node 220. Similarly, transistors 266 and 276 form a transistor group connected to node 222 and transistors 268 and 278 form another transistor group connected to node 222.

Transistors 262, 264, 272, and 274 have a common source connected to node 220. Transistors 262 and 272 have gates connected to a reference node 280. Transistors 264 and 274 have gates connected to a weighting node 290 to receive a weighting voltage signal Vw. A weighting generator 292 generates Vw. In some embodiments, Vw is a DC voltage signal that has a potential unequal to the potential of node 280. Transistor 262 has a drain connected to node 224. Transistor 264 has a drain connected to node 226. From node 220, I1 splits into I1*a* and I1*b*. I1*a* flows through transistors 262 and 272. I1*b* flows through transistors 264 and 274. I(262) is a portion of I1*a* flowing through transistor 262 to node 224. I(272) is another portion of I1*a* flowing through transistor 272 to node 280. I(264) is a portion of I1*b* flowing through transistor 264 to node 226. I(274) is another portion of I1*b* flowing through transistor 274 to node 280.

In a similar arrangement, transistors 266, 268, 276 and 278 have a common source connected to node 222. Transistors 268 and 278 have gates connected to reference node 280. Transistors 266 and 276 have gates connected to node 290. Transistor 266 has a drain connected to node 224. Transistor 268 has a drain connected to node 226. From node 222, I2 splits into I2*a* and I2*b*. I2*a* flows through transistors 266 and 276. I2*b* flows through transistors 268 and 278. I(266) is a portion of I2*a* flowing through transistor 266 to node 224. I(276) is another portion of I2*a* flowing through transistor 276 to node 280. I(268) is a portion of I2*b* flowing through transistor 268 to node 226. I(278) is another portion of I2*b* flowing through transistor 278 to node 280.

Output stage 214 outputs I5 and I6 that are proportional to I1 and I2. Since I1 and I2 are obtained from I3 and I4 which are proportional to V1 and V2, I5 and I6 are proportional to the product of V1, V2, and Vw. The values of I5 and I6 can be controlled by selecting the parameters of output transistors 262, 264, 266, and 268 and the parameters of scaling transistors 272, 274, 276, and 278. For example, the channel widths and channel lengths of the output transistors and the scaling transistors can be selected such that the values of I5 and I6 are proportional to the ratio of the channel widths of the output transistors to the channel widths of the scaling transistors.

In embodiments represented by FIG. 2, transistors of input stage 210 and output stage 214 are p-channel metal oxide semiconductor field effect transistors (PMOSFET), also referred to as "PFET" or "PMOS". In some embodiments, these transistors are n-channel metal oxide semiconductor field effect transistors (NMOSFET) also referred to as "NFET" or "NMOS". Other types of transistors can also be used in place of the NMOS and PMOS transistors. For example, embodiments exist that use bipolar junction transistors (BJTs) and junction field effect transistors (JFETs). One of ordinary skill in the art will understand that many other types of transistors can be used in alternative embodiments the present invention.

Each of the transistors of output stage 214 has a channel width and a channel length. In FIG. 2, W indicates the channel width and L indicates the channel length. In some embodiments, the transistors of output stage 214 have equal channel length and equal channel width. In some other embodiments, the transistors of output stage 214 have unequal channel width to channel length ratio. In embodiments represented by FIG. 2, all of the transistors of output stage 214 have equal channel length as indicated by L. Transistors 262, 264, 266, and 268 have equal channel width as indicated by W. Transistors 272, 274, 276, and 278 have equal channel width as indicated by XW. Each of transistors 262, 264, 266, and 268 has a channel width to channel length ratio indicated by W/L. Each of transistors 272, 274, 276, and 278 has a channel width to length ratio indicated by XW/L. In some embodiments, X is an integer equal to or greater than two. Therefore, the channel widths of transistors 272, 274, 276, and 278 are a multiple of the channel widths of transistors 262, 264, 266, and 268. In some other embodiments, X is a positive quantity. Thus, the channel widths of transistors 272, 274, 276, and 278 are greater than but not necessarily a multiple of the channel widths of transistors 262, 264, 266, and 268. Since X is a positive quantity, XW/L is unequal to W/L. Further when X is an integer equal to or greater than two, XW/L is a multiple of W/L.

Transistors 262 and 266 form a first summing path to connect nodes 220 and 222 to node 224. Currents I(262) and I(266) sum on node 224 to form I5. Transistors 264 and 268 form a second summing path to connect nodes 220 and 222 to node 226. Currents I(264) and I(268) sum on node 226 to form I6. Transistors 272 and 274 form a current-diverting path connected between nodes 220 and 280. Currents I(272) and I(274) flows from node 220 to node 280. Transistors 276 and 278 form a current-diverting path connected between nodes 222 and 280. Currents I(276) and I(278) flows from node 222 to node 280.

As shown in FIG. 2, I1*a* is divided into I(262) and I(272). I1*b* is divided into I(264) and I(274). I2*a* is divided into I(266) and I(276). I2*b* is divided into I(268) and I(278).

Based on the paths of I1*a*, I1*b*, I2*a*, and I2*b*, the transistors of output stage 214 form a number of current dividers. For example, transistors 262 and 272 form a current divider that divides I1*a*. Similarly, transistors 264 and 274, 266 and 276, and 268 and 278 form other current dividers that divide I1*b*, I2*a*, and I2*b*, respectively.

Since transistors 262 and 272 form a current divider and transistors 262 and 272 have equal channel length, the current flowing through each of transistors 262 and 272 is proportional to its channel width. Thus, when the channel width of transistor 262 is W and the channel width of transistor 272 is XW, the current flowing through transistor 262, I(262), is calculated as follows:

$$I(262)=I1a[W/(W+XW)]$$

$$\text{or } I(262)=I1a[W/(W(1+X))]$$

$$\text{or } I(262)=I1a[1/(1+X)] \quad (1)$$

Based on equation (1), I(262) can be chosen (or scaled) to be any fraction of I1*a* by selecting the value for X. For example, when I(262) is chosen to be one-tenth (1/10) of I1*a*, in equation (1), 1/(1+X) would be 1/10, i.e., 1/(1+X)=1/10; solving the equation gives X=9. Thus, when I(262) is chosen to be one-tenth (1/10) of I1*a*, the channel width of transistor 272 is selected to be nine times larger than the channel width of transistor 262. Similarly, I(264) can also be chosen to be a fraction of I1*b* by selecting the channel width of transistor 274 to be X times larger than the channel width of transistor 264. By the same method, I(266) and I(268) can be chosen to be a fraction of I2*a* and I2*b*, respectively, by choosing the channel widths of transistor pairs 266 and 276, and 268 and 278.

Equation (1) and the above example show that each of currents I(262), I(264), I(266), and I(268) is proportional to the ratio of the channel widths of transistors 262 and 272, 264 and 274, 266 and 276, and 268 and 278, respectively. Since I5 equals the sum of I(262) and I(266), and I6 equals the sum of I(264) and I(268), I5 and I6 is also proportional to the ratio of the channel widths of transistors 262 and 272, 264 and 274, 266 and 276, and 268 and 278.

Figure 3:
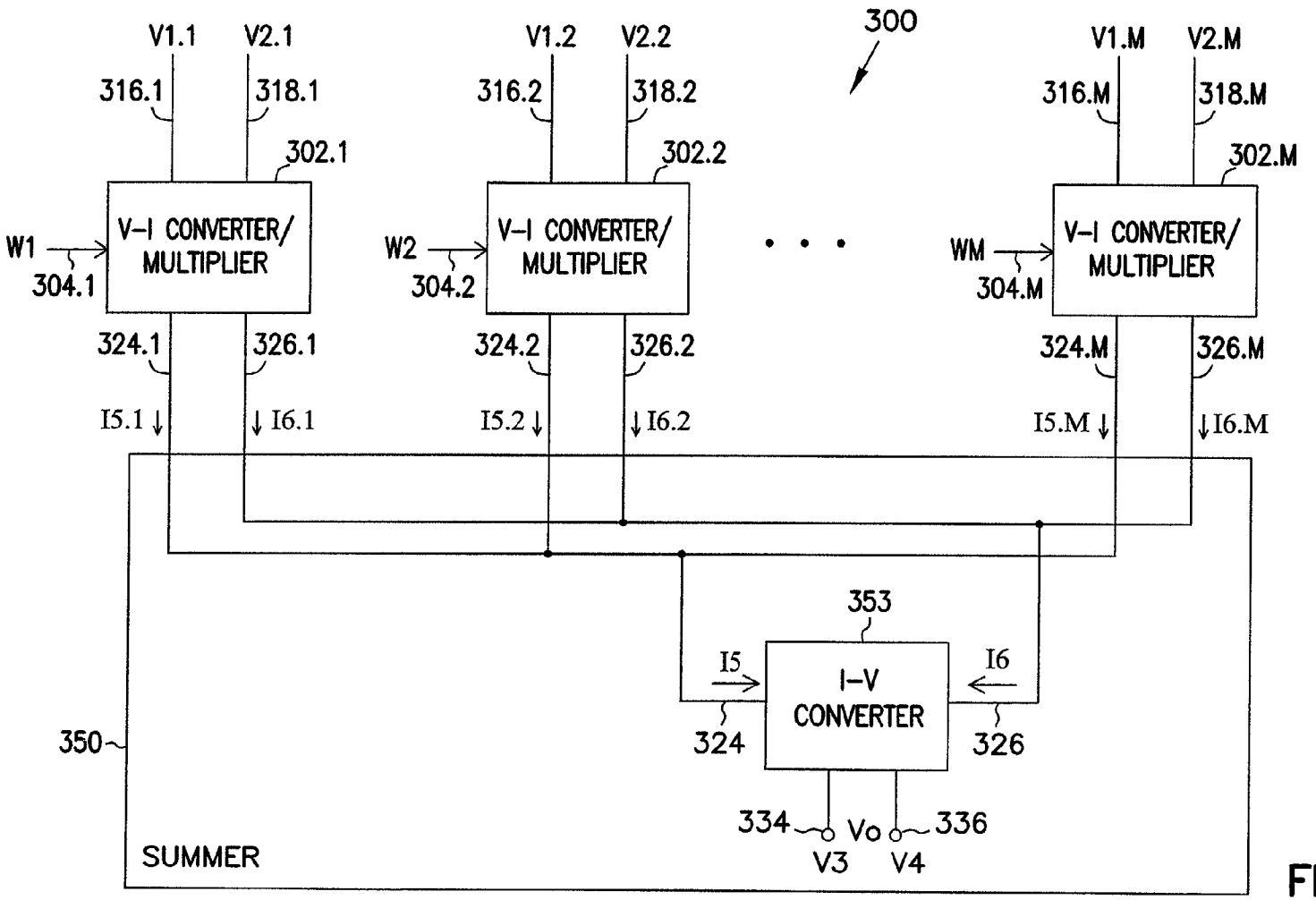
FIG. 3 shows a functional unit.

FIG. 3 shows a block diagram of a functional unit 300. Functional unit 300 includes a plurality of V-I converter/multipliers 302.1, 302.2 through 302.M, and a summer 350. Each of V-I converter/multipliers has multiplier input nodes and multiplier output nodes. For example, V-I converter/multiplier 302.1 has multiplier input nodes 316.1 and 318.1 to receive multiplier input signals V1.1 and V2.1, and multiplier output nodes 324.1 and 326.1 to provide output currents I5.1 and I6.1. As another example, V-I converter/multiplier 302.M has multiplier input nodes 316.M and 318.M to receive multiplier input signals V1.M and V2.M, and multiplier output nodes 324.M and 326.M to provide output currents I5.M and I6.M. Each of the V-I converter/multipliers also connects to a corresponding weighting node to receive a corresponding weighting signal. For example, V-I converter/multiplier 302.1 connects to weighting node

304.1 to receive a weighting signal W1. V-I converter/multiplier 302.2 connects to weighting node 304.2 to receive a weighting signal W2. V-I converter/multiplier 302.M connects to weighting node 304.M to receive a weighting signal WM.

Summer 350 includes a current-to-voltage (I-V) converter 353, summing nodes 324 and 326, and output nodes 334 and 336. Nodes 324 and 326 receive currents I5 and I-, I-V converter 353 converts currents I5 and I6 into voltages V3 and V4. Summer 350 further provides an output voltage Vo, which is the difference between V3 and V4 at nodes 334 and 336. Summer 350 sums currents I5.1 through I5.M to produce I5 at node 324. Thus, I5 equals the sum of I5.1 through I5.M. Summer 350 sums currents I6.1 through I6.M to produce I6 at node 326. Thus, I6 equals the sum of I6.1 through I6.M.

I-V converter 353 can be any I-V converter known to those skilled in the art. For example, I-V converter 353 can be a differential I-V converter that converts differential input currents into differential output voltages, in which the differential output voltages are proportional to the differential input currents. Any I-V converter capable of converting input currents into output voltages can be used in alternative embodiments of the present invention.

Each of V-I converter/multipliers 302.1 through 302.M is similar to and operates in a similar fashion as multiplier 200 (FIG. 2). Each of V1.1 through V1.M is similar to V1 (FIG. 2). Each of V2.1 through V2.M is similar to V2 (FIG. 2). Each of I5.1 through I5.M is similar to I5 (FIG. 2). Each of I6.1 through I6.M is similar to I6 (FIG. 2). Each of W1 through WM is similar to Vw (FIG. 2).

Functional unit 300 can be a part of a signal filter such as a finite impulse response (FIR) filter, an equalizer, or other device that receives one or more signals and performs multiplication, or addition, or both to the signals. In some embodiments, functional unit 300 performs the multiplication and addition to signals received at a receiver to restore the signals to their original form, when the signals are distorted during transmission.

Figure 4:
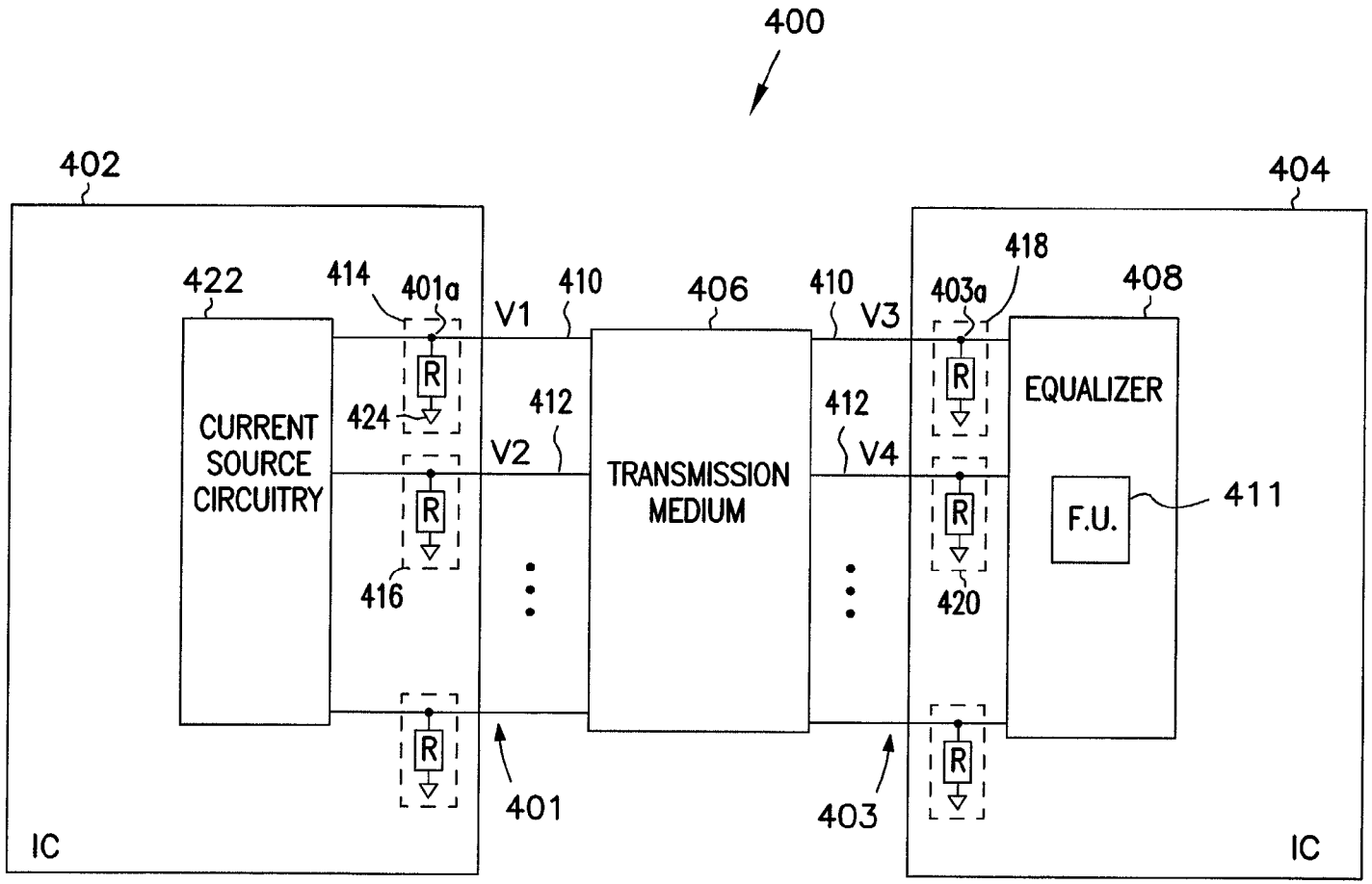
FIG. 4 shows a system.

FIG. 4 shows a system. System 400 includes an integrated circuit (IC) 402, an IC 404, and a transmission medium 406 connected between ICs 402 and 404 for data communication between IC 402 and IC 404. In some embodiments, transmission medium 406 connects to IC 402 at nodes 401 and IC 404 at nodes 403. IC 404 includes an equalizer 408. Equalizer 408 includes a functional unit (F.U.) 410. Functional unit 410 represents functional unit 300 (FIG. 3). In embodiments represented by FIG. 4, IC 402 represents a transmitter to transmit a plurality of signals to IC 404, which represents a receiver.

In some embodiments, transmission medium 406 is a point-to-point transmission medium having a plurality of transmission lines such as transmission lines 410 and 412. Each of the transmission lines connects to a termination impedance of IC 402 and a termination impedance of IC 404. For example, transmission lines 410 and 412 connect to termination impedances 414 and 416 of IC 402, and connect to termination impedances 418 and 420 of IC 404. Each of the termination impedances includes a resistive element (R) connected to the corresponding transmission line and a supply node. A resistive element of IC 402 connects to the corresponding transmission line at a driver node. A resistive element of IC 404 connects to the corresponding transmission line at a receiver node. For example, the resistive element of termination impedance 414 connects to transmission line 410 at driver node 401*a*. The resistive element of termination impedance 418 connects to transmission line 410 at receiver node 403*a*. Each of the resistive elements connects to supply node 424. In some embodiments, supply node 424 connects to ground. In other embodiments, supply node 424 connects to a non-zero voltage.

IC 402 includes a current source circuitry 422 to source a driver current onto each of the transmission lines. A portion of the driver current develops a voltage at the driver node. Another portion of the driver current travels on the transmission medium and develops a voltage at the receiver node. V1, V2, V3, and V4 indicate the voltages developed at the driver nodes of IC 402 and at the receiver nodes of IC 404.

In some embodiments, equalizer 408 samples V3 and V4 to produce a plurality of sampled signals. For example, in some embodiments, equalizer 408 samples V3 to produce sampled signals such as the V1.1 through V1.M signals (FIG. 3), and samples V4 to produce sampled signals such as the V2.1 through V2.M signals (FIG. 3). During a signal processing operation, equalizer 408 performs multiplication and addition to V1.1 through V1.M and V2.1 through V2.M to restore the original form of the V1 and V2 signals, when they are distorted during transmission from IC 402 to IC 404.

IC 402 and IC 404 can be any type of integrated circuit. For example, IC 402 or IC 404 can be a processor such as a microprocessor, a digital signal processor, a microcontroller, or the like. IC 402 and IC 404 can also be an integrated circuit other than a processor such as an application-specific integrated circuit, a communications device, a memory controller, or a memory such as a dynamic random access memory.

System 400 can be of any type. Examples of system 400 include computers (e.g., desktops, laptops, handhelds, servers, Web appliances, routers, etc.), wireless communications devices (e.g., cellular phones, cordless phones, pagers, personal digital assistants, etc.), computer-related peripherals (e.g., printers, scanners, monitors, etc.), entertainment devices (e.g., televisions, radios, stereos, tape and compact disc players, video cassette recorders, camcorders, digital cameras, MP3 (Motion Picture Experts Group, Audio Layer 3) players, video games, watches, etc.), and the like.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. Therefore, it is intended that this invention be limited only by the claims and the equivalents thereof.

What is claimed is:

1. A circuit comprising:

an input stage to produce a first current at a first source node and a second current at a second source node;

a plurality of output transistors connected between the first and second source nodes and a first summing node and a second summing node to pass a first portion of the first current and a first portion of the second current to the first and second summing nodes; and a plurality of scaling transistors connected between the first and second source nodes and a reference node to pass a second portion of the first current and a second portion of the second current to the reference node, wherein each of the output transistors includes a first channel width to channel length ratio, wherein each of the scaling transistors includes a second channel width to channel length ratio, and wherein the first channel width to channel length ratio is different from the second channel width to channel length ratio.

2. A circuit comprising:

an input stage to produce a first current at a first source node and a second current at a second source node;

a plurality of output transistors connected between the first and second source nodes and a first summing node and a second summing node to pass a first portion of the first current and a first portion of the second current to the first and second summing nodes; and a plurality of scaling transistors connected between the first and second source nodes and a reference node to pass a second portion of the first current and a second portion of the second current to the reference node; and a current reduction unit connected between the first and second source nodes to subtract a DC current from the input stage.

3. The circuit of claim 2, wherein each of the output transistors includes a first channel width, and each of the scaling transistors includes a second channel width, wherein the first and second channel widths are unequal.

4. A circuit comprising:

an input stage to produce a first current at a first source node and a second current at a second source node;

a plurality of output transistors connected between the first and second source nodes and a first summing node and a second summing node to pass a first portion of the first current and a first portion of the second current to the first and second summing nodes; and a plurality of scaling transistors connected between the first and second source nodes and a reference node to pass a second portion of the first current and a second portion of the second current to the reference node, wherein each of the output transistors includes a first channel width, and each of the scaling transistors includes a second channel width, wherein the second channel width is a multiple of the first channel width.

5. The circuit of claim 4, wherein the input stage includes a differential pair of transistors connected to the first and second source nodes.

6. The circuit of claim 5, wherein one of the output transistors and one of the scaling transistors connect to a weighting node to receive a weighting signal.

7. A circuit comprising:

an input stage to source a first current to a first source node and a second current to a second source node;

a first summing path connected to the first and second source nodes to pass a first portion of the first current and a first portion of the second current to a first summing node;

a second summing path connected to the first and second source nodes to pass a second portion of the first current and a second portion of the second current to a second summing node, each of the first and second summing paths including a plurality of output transistors;

a first current-diverting path connected to the first source node to pass a third portion of the first current to a reference node; and a second current-diverting path connected to the second source node to pass a third portion of the second current to the reference node, each of the first and second current-diverting paths including a plurality of scaling transistors.

8. The circuit of claim 7, wherein each of the output transistors includes a first channel width, and each of the scaling transistors includes a second channel width, wherein the first and second channel widths are unequal.

9. The circuit of claim 8 further comprising at least one current source connected between the first and second current source nodes to subtract a DC current from the input stage.

10. The circuit of claim 7, wherein each of the output transistors includes a first channel width, and each of the scaling transistors includes a second channel width, wherein the second channel width is a multiple of the first channel width.

11. The circuit of claim 10, wherein the input stage includes:

a first input transistor connected to a first input node to convert a first input voltage signal at the first input node into the first current; and a second input transistor connected to a second input node to convert a second input voltage signal at the second input node into the second current.

12. A circuit comprising:

an input stage including a first input transistor and a second input transistor;

a first output transistor connected between the first input transistor and a first summing node, and a second output transistor connected between the second input transistor and the first summing node;

a third output transistor connected between the first input transistor and a second summing node, and a fourth output transistor connected between the second input transistor and the second summing node, the first, second, third, and fourth output transistors having a first channel width; and a first scaling transistor and a second scaling transistor, each being connected between the first input transistor and a reference node, and a third scaling transistor and a fourth scaling transistor, each being connected between the second output transistor and the reference node, the first, second, third, and fourth scaling transistors having a second channel width, wherein the second channel width and the first channel width are unequal.

13. The circuit of claim 12, wherein:

the first input transistor includes a source connected to a supply node, a drain connected to a first source node, and a gate connected to a first input node to receive a first input signal; and the second input transistor includes a source connected to the supply node, a drain connected to a second source node, and a gate connected to a second input node to receive a second input signal.

14. The circuit of claim 13 further comprising a first current source connected between a common node and the first source node to subtract a DC current generated by the input stage at the first source node.

15. The circuit of claim 14 further comprising a second current source connected between the common node and the second source node to subtract a DC current generated by the input stage at the second source node.

16. The circuit of claim 12, wherein the second channel width is a multiple of the first channel width.

17. The circuit of claim 16, wherein the second and third output transistors and the second and third scaling transistors connect to a weighting node to receive a weighting signal.

18. An integrated circuit comprising:

a plurality of multipliers to receive a plurality of multiplier input signals; and a summing circuit connected to the multipliers to sum currents at a first summing node and a second summing node, wherein each of the multiplier includes:

an input stage connected to a first source node and a second source node; and a plurality of transistor pairs connected to the first and second source nodes, wherein each of the transistor pairs includes transistors having unequal channel width to channel length ratios and having a common source connected to one of the first and second source nodes.

19. The integrated circuit of claim 18, wherein the input stage includes a differential pair of transistors connected to the first and second source nodes.

20. The integrated circuit of claim 19 further comprising a current source connected to one of the first and second source nodes to subtract a DC current generated by the input stage.

21. The integrated circuit of claim 18, wherein a channel width to channel length ratio of a transistor in a transistor pair is a multiple of a channel width to channel length ratio of another transistor in the transistor pair.

22. The integrated circuit of claim 21 further comprising a plurality of nodes to receive a plurality of input signals to produce the multiplier input signals.

23. A system comprising:

a transmitter;

a point-to-point transmission medium connected to the transmitter to transmit a plurality of transmitted signals; and a receiver connected to the point-to-point transmission medium to receive the transmitted signals and produce a plurality of sampled signals, the receiver including:

a plurality of multipliers to receive the plurality of sampled signals and a plurality of code input signals; and a summing circuit connected to the multipliers to sum currents at a first summing node and a second summing node, wherein each of the multiplier includes:

an input stage connected to a first source node and a second source node; and a plurality of transistor pairs connected to the first and second source nodes, wherein each of the transistor pairs includes transistors having unequal channel width to channel length ratios and having a common source connected to one of the first and second source nodes.

24. The integrated circuit of claim 23, wherein a channel width to channel length ratio of a transistor in a transistor pair is a multiple of a channel width to channel length ratio of another transistor in the transistor pair.

25. The integrated circuit of claim 24 further comprising a current reduction unit connected between the first and second source nodes.

26. The circuit of claim 23, wherein the point-to-point transmission medium includes a plurality of transmission lines, each connecting to a termination impedance of the transmitter and a termination impedance of the receiver.

27. The circuit of claim 26, wherein the transmitter includes a current source circuitry to source a driver current onto the termination impedances of the transmitter and the receiver.

28. A method comprising:

producing a first current at a first source node;

producing a second current at a second source node;

passing a first portion of the first current and a first portion of the second current to a first summing node; and passing a second portion of the first current and a second portion of the second current to a second summing node; and passing a third portion of the first current and a third portion of the second current to a reference node.

29. The method of claim 28, wherein the first portion of the first current and the first portion of the second current are passed to the first summing node via a plurality of first output transistors, wherein the second portion of the first current and the second portion of the second current are passed to the second summing node via a plurality of second output transistors, wherein the third portion of the first current and the third portion of the second current are passed to the reference node via a plurality of scaling transistors, wherein the first output transistors and the second output transistor have a first channel width, and wherein the scaling transistors have second channel width.

30. The method of claim 28, wherein second channel width is a multiple of the first channel width.

* * * * *